US005988833A

United States Patent [19]

Giese et al.

[11] Patent Number: 5,988,833

[45] Date of Patent: Nov. 23, 1999

[54] ADAPTABLE DIRECTIONAL FLOODLIGHT

[75] Inventors: Robert D. Giese; Eric J. Haugaard, both of Kenosha; Donald Wandler, Racine, all of Wis.

[73] Assignee: Ruud Lighting, Inc., Racine, Wis.

[21] Appl. No.: 08/990,597

[22] Filed: Dec. 15, 1997

[51] Int. Cl.[6] ..... F21V 21/30

[52] U.S. Cl. ..... 362/287; 362/311; 362/427; 362/455

[58] Field of Search ..... 362/263, 265, 362/287, 418, 427, 359, 311, 455

[56] References Cited

U.S. PATENT DOCUMENTS

| | | | |
|---|---|---|---|
| 4,626,975 | 12/1986 | Miletich | 362/418 |
| 4,760,511 | 7/1988 | Russello et al. | 362/427 |
| 5,584,574 | 12/1996 | Haddad | 362/359 |
| 5,593,224 | 1/1997 | Kunkel et al. | 362/287 |
| 5,599,091 | 2/1997 | Kira | 362/269 |
| 5,651,606 | 7/1997 | Krogman | 362/359 X |
| 5,713,662 | 2/1998 | Kira | 362/427 |
| 5,758,958 | 6/1998 | Chen | 362/311 X |
| 5,882,109 | 3/1999 | McKinney et al. | 362/311 X |

OTHER PUBLICATIONS

L.E. Mason Co. Red Dot Sitelight Swivel Light Installation Instructions 1995.

L. E. Mason Co. Red Dot Sitelight Wall Spot Light Installation Instructions 1995.

*Primary Examiner*—Laura K. Tso

*Attorney, Agent, or Firm*—Jansson, Shupe, Bridge & Munger, Ltd.

[57] ABSTRACT

A floodlight has a housing and a housing support coupled to the housing. In the improvement, the support includes a strut extending along a strut axis and having a distal end and a pivot member at a proximal end. The pivot member is mounted for movement about an axis of rotation and has a boundary spaced from the axis of rotation by a first dimension. The housing includes a housing surface proximate the axis of rotation and spaced therefrom by a second dimension less than the first dimension. The housing includes a recess therealong and when the strut is folded against the housing, the strut is received in the recess. A group of floodlight components comprises a main housing and two or more differently-shaped center housings. The attachment portions of the center housings are sized and configured to be interchangeably received at the main housing forward opening. The group thereby accommodates any one of several different lamps, e.g., PAR 20, PAR 30 and/or PAR 38.

23 Claims, 6 Drawing Sheets

ADAPTABLE DIRECTIONAL FLOODLIGHT

FIELD OF THE INVENTION

This invention relates generally to illumination and, more particularly, to light source supports or housings and light modifiers.

BACKGROUND OF THE INVENTION

Floodlights are available in two broad types, i.e., area and directional. As the name suggests, the former are used to illuminate large areas such as parking lots. Directional floodlights provide a smaller field of illumination and are popular with architects, lighting designers and building owners as a way to visually "highlight" certain building and landscape features and improve the nighttime appearance and ease of use of buildings and grounds.

Directional floodlights are used for such purposes as "uplighting" the foliage of trees, illuminating stairs and walkways and emphasizing (by illumination) a particular architectural or structural feature. And the improvement can be dramatic—one need only compare a darkened or poorly-illuminated property to one selectively illuminated by well-sized, well-placed directional floodlights to appreciate the aesthetic differences.

A large property may require a dozen or even several dozen well-placed floodlights for the purpose. And as architects and lighting designers are well aware, these floodlights are likely to require differing lamps to provide differing levels of illumination. Lamps used for outdoor floodlight illumination cover a range of lamp sizes (both physical size and wattage rating) including MR 16 low voltage lamps, PAR 20, PAR 30 and PAR 38 line voltage lamps and high intensity discharge (HID) lamps. (The acronym "PAR" is recognized in the industry as meaning a lamp with a parabolic aluminized reflector.)

A common practice of manufacturers of directional floodlights is to make a separate set of floodlight hardware for each lamp size to be used. The resulting multiplicity of components incrementally increases manufacturing costs and has a significant (and unfavorable) impact upon inventory, both for the manufacturer and for the contractor called upon to install the floodlights. That is, both the manufacturer and contractor must keep track of a larger number of component parts and run the increased risk of loss of some.

And that is not all. Architects and lighting designers are justifiably concerned that each floodlight be capable of being precisely directed toward the particular feature to be illuminated. This means that the floodlight should have a mounting arrangement that permits a wide range of aiming angles.

Directional floodlights involve another consideration, namely, installation space. While directional floodlights for the largest lamp noted above, the PAR 38 lamp, are not particularly large, even modest space savings can be meaningful. (A PAR 38 lamp has a lens diameter of about 4.75 inches, i.e., about 12 cm.)

A new directional floodlight which better responds to the needs of architects, lighting designers and contractors and which provides certain manufacturing economies would be an important advance in the art.

OBJECTS OF THE INVENTION

It is an object of the invention to provide an improved directional floodlight which addresses some of the problems and shortcomings of the prior art.

Another object of the invention is to provide a group of directional floodlight components which effects certain economies in manufacture.

Another object of the invention is to provide a group of directional floodlight components which effects certain economies in inventory and inventory management.

Still another object of the invention is to provide an improved directional floodlight which can be aimed over a broad range of angles.

Another object of the invention is to provide an improved directional floodlight which effects incremental savings in mounting space. How these and other objects are accomplished will become apparent from the following descriptions and from the drawings.

SUMMARY OF THE INVENTION

Aspects of the invention involve a directional floodlight of the type having a housing and a housing support coupled to the housing. In the improvement, the support includes an elongate, bar-like strut extending along a strut axis and having distal and proximal ends. A pivot member is at the proximal end and is coupled to a substantially cylindrical mounting boss affixed to the housing and, in a specific embodiment, is integrally formed with such housing.

The pivot member is mounted for movement about an axis of rotation and has a surface or boundary spaced from the axis of rotation by a first dimension. The housing includes a housing surface which is proximate the axis of rotation and spaced therefrom by a second dimension less than the first dimension. When the housing is so configured, the pivot member is partially "tucked" into the housing.

More specifically, the pivot member is cylinder-shaped, coextensive with the housing mounting boss and has a boundary defining a convex surface. The radius of curvature of such surface is equal to the first dimension. The housing also has a concave pivot surface that has a radius of curvature greater than either the first or the second dimension.

In another aspect of the invention, the housing includes a long axis and an elongate recess along that part of the housing to which the mounting boss and pivot member are attached. When the strut is folded against the housing, the strut is in the recess, i.e., partially "tucked" into the housing. More specifically, the housing includes a forward opening symmetrical about the housing long axis. When the strut is folded against the housing, the strut axis is substantially parallel to the housing long axis.

In still another aspect of the invention, the housing comprises a body with the mounting boss attached thereto. The body has a rear body terminus and a forward body opening and is substantially symmetrical about a plane coincident with such terminus and opening. The mounting boss has an annular face substantially coincident with the plane. Similarly, the pivot member has a face substantially coincident with the plane. In other words, the "interface" between the stationary mounting boss and the movable pivot member is at the plane.

In yet another aspect of the invention, the housing described above is the main housing for the floodlight. Such floodlight further includes alternate first and second center housings, either of which can be mounted to the main housing. Each of the center housings includes an attachment portion sized to be received by the forward opening with slight clearance and a lamp-protecting portion extending from the attachment portion.

Each of the lamp-protecting portions has a diameter and the diameter of the lamp-protecting portion of the first center housing is less than the diameter of the lamp-protecting portion of the second center housing. So configured, the floodlight can be fitted with the first center housing to receive, for example, a PAR 20 lamp or be fitted with the second center housing to receive a larger lamp, e.g., a PAR 30 lamp or a PAR 38 lamp. (In another specific configuration used with MR 16 low voltage lamps, the main housing has no center housing affixed thereto. Rather, a lens housing is affixed directly to the main housing.)

And the new floodlight is not limited to use with low voltage or PAR lamps. In another embodiment, the main housing includes a socket for receiving an HID lamp. The floodlight further includes an elongate compartment containing a ballast attached to the lamp and the compartment includes a mounting box and a cover mounted thereon and having the distal end of the strut affixed to it.

Another aspect of the invention involves a group of floodlight components comprising a main housing and first and second center housings. Such center housings have, respectively, first and second attachment portions and a first and second ring terminus. The components group also includes first and second lens housings sized to be received on the first and second ring terminus, respectively. As described otherwise above, the first and second attachment portions are sized and configured to be interchangeably received at the forward opening.

A more specific group of floodlight components includes a third center housing having a third attachment portion and a third ring terminus. Like the first and second attachment portions of the first and second center housings, respectively, the third attachment portion is sized and configured to be received at the forward opening.

A still-more-specific group of components includes at least a first shroud for further glare prevention and to provide greater "directionality." Such shroud is received on the first ring terminus and in place of the first lens housing.

For water exclusion at the "slip-fit" joint between the main housing and the center housing, it is preferred that the first and second center housings each include a first seal ring at their respective attachment portions. And for water exclusion at the slip-fit joint between the ring terminus and the ring-like lens housing, each of the first and second center housings includes a second seal ring at its ring terminus.

Other details of the invention are set forth in the following detailed description and in the drawings.

DETAILED DESCRIPTION OF PREFERRED EMBODIMENTS

Figure 1:
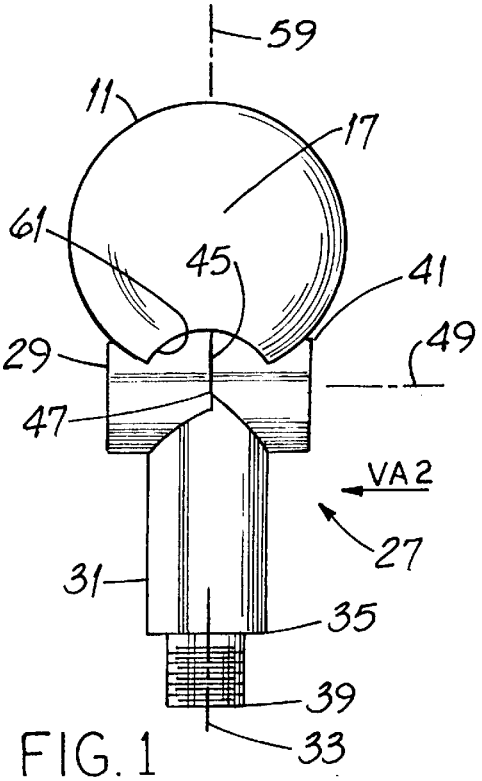
FIG. 1 is a rear elevation view of the main housing used with the described embodiments of the new floodlight. The housing is shown with the pivotable support strut extending downwardly.

Depending upon the specific embodiment, the new directional floodlight 10 is configured to accept the MR 16 low voltage lamp, the PAR 20, PAR 30 or PAR 38 line voltage lamp or any one of several high intensity discharge (HID) lamps ranging in size from about 40 watt to about 100 watt. Since the main housing 11 is common to all of the embodiments, it will be described first.

Referring to FIGS. 1 through 6, the main housing 11 has a body 13 which is generally cylindrical, which is closed at one end by a hemispheric dome 15 having a rear body terminus 17 and which has a forward opening 19 away from the terminus 17. The forward opening 19 includes a rim 21 and a lip 23 extending therefrom and the diameter of the lip 23 is somewhat less than that of the rim 21. Formed in the body 13 is a pair of threaded holes 25 to receive screws extended through corresponding holes in the center housings described below. Such screws secure a center housing to the main housing 11.

A housing support 27 is coupled to the body 13 and includes a substantially cylindrical mounting boss 29 integrally formed with the body 13. That is, the body 13 and the boss 29 are rigid with respect to one another. The support 27 also includes an elongate, bar-like strut 31 extending along a strut axis 33 and having distal and proximal ends 35 and 37, respectively. The distal end 35 includes a threaded nipple 39 for attaching the strut 31 to a junction box or mounting box in a known manner.

A generally cylindrical pivot member 41 is at the proximal end 37 of the strut 31, is integrally formed with the strut 31 and is coextensive with the boss 29. In a specific embodiment, the boss 29 and the pivot member 41 have the same radius of curvature R1.

A threaded bolt extends through an opening 43 in the pivot member 41 and threads into a female threaded hole in the boss 29. The faces 45, 47 of the boss 29 and the pivot member 41, respectively, have radial serrations thereon that engage and prevent relative movement of the boss 29 and the member 41 when the bolt is snug. But when the bolt is loosened slightly, the pivot member 41 and the boss 29 can be separated to a degree sufficient to permit the pivot member 41 to be moved about the axis of rotation 49. In a specific embodiment, the maximum included angle Al between the housing axis 51 and the strut axis 33 is about 125°.

Referring particularly to FIGS. 1, 2, 4 and 7, the pivot member 41 has an arc-shaped convex boundary or surface 53 spaced from the axis of rotation 49 by a first dimension. In a specific embodiment, the first dimension between the axis 49 and the surface 53 is equal to the radius of curvature R1. The housing 11 includes a housing surface 55 which is proximate the axis of rotation 49 and spaced therefrom by a second dimension D2 less than the first dimension R1. The housing 11 also has a concave pivot surface 57 which, in a specific embodiment, is arc-shaped and has a radius of curvature R2 greater than either the first or the second dimension R1 or D2.

Figure 2:
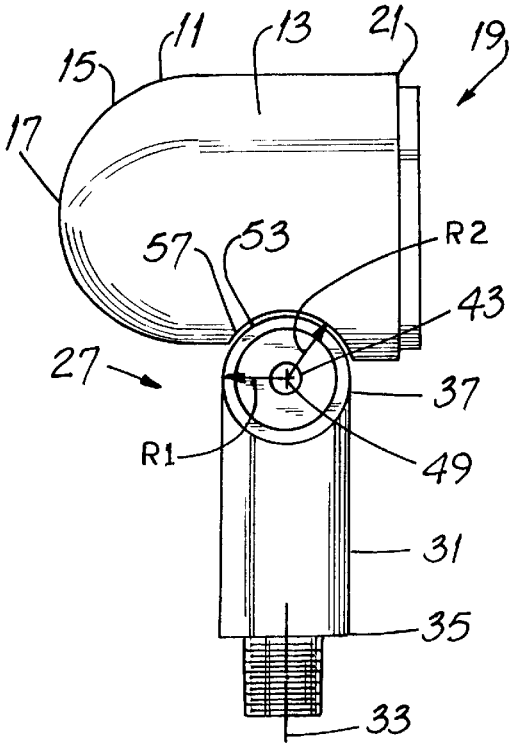
FIG. 2 is a side elevation view of the housing of FIG. 1 taken along the viewing axis VA2 thereof.

Referring now to FIGS. 1 and 2, the body 13 is substantially symmetrical about a plane 59 coincident with the rear terminus 17, the forward opening 19 and the strut axis 33. The annular faces 45, 47 of the boss 29 and pivot member 41, respectively, are substantially coincident with the plane 59.

Figure 4:
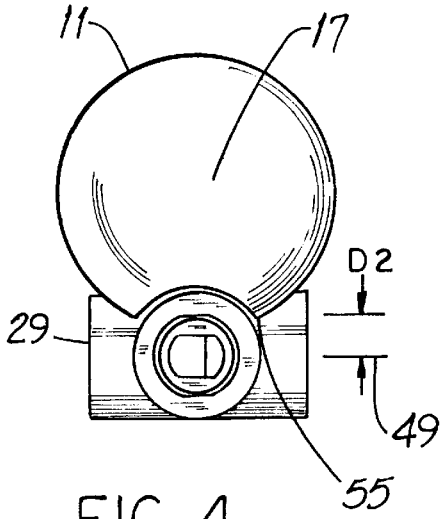
FIG. 4 is a rear elevation view of the housing of FIG. 3 taken along the viewing axis VA4 thereof.
Figure 3:
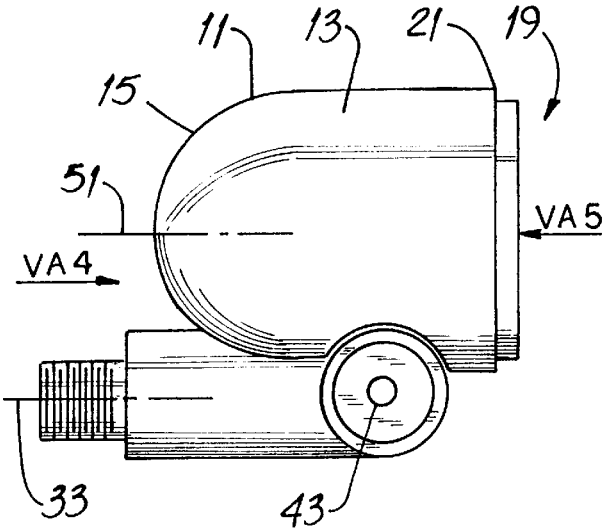
FIG. 3 is a side elevation view of the housing of FIG. 2 with the support strut pivoted against the housing body.
Figure 5:
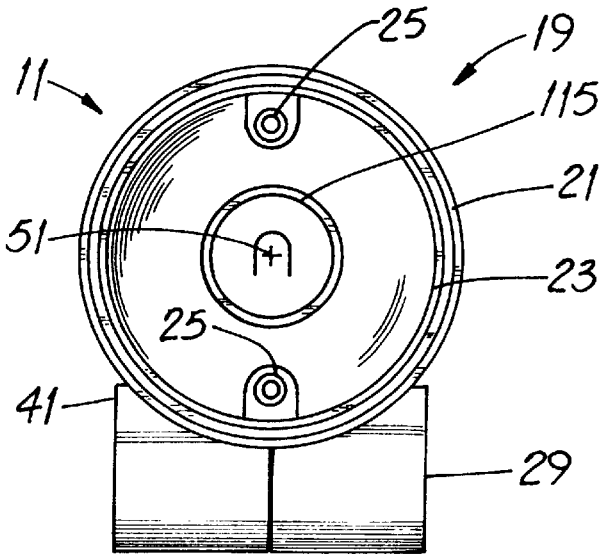
FIG. 5 is a front elevation view of the housing of FIG. 3 taken along the viewing axis VA5 thereof.
Figure 12:
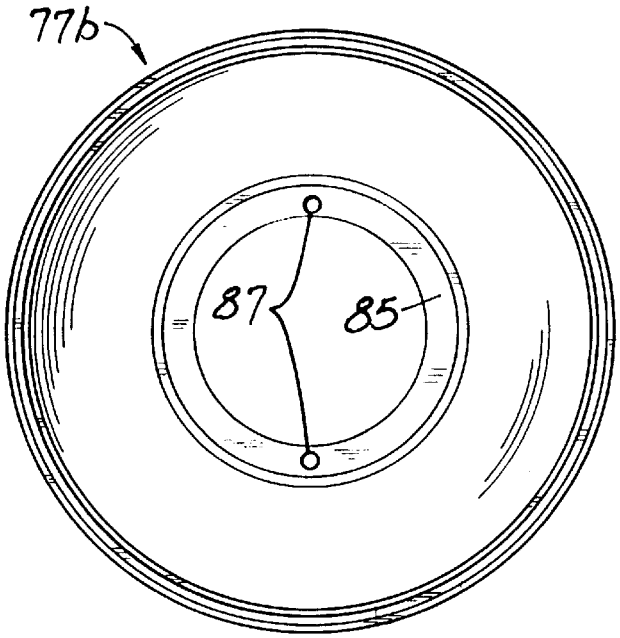
FIG. 12 is an elevation view of the center housing of the floodlight of FIG. 10 taken along the viewing plane 12—12 thereof.
Figure 6:
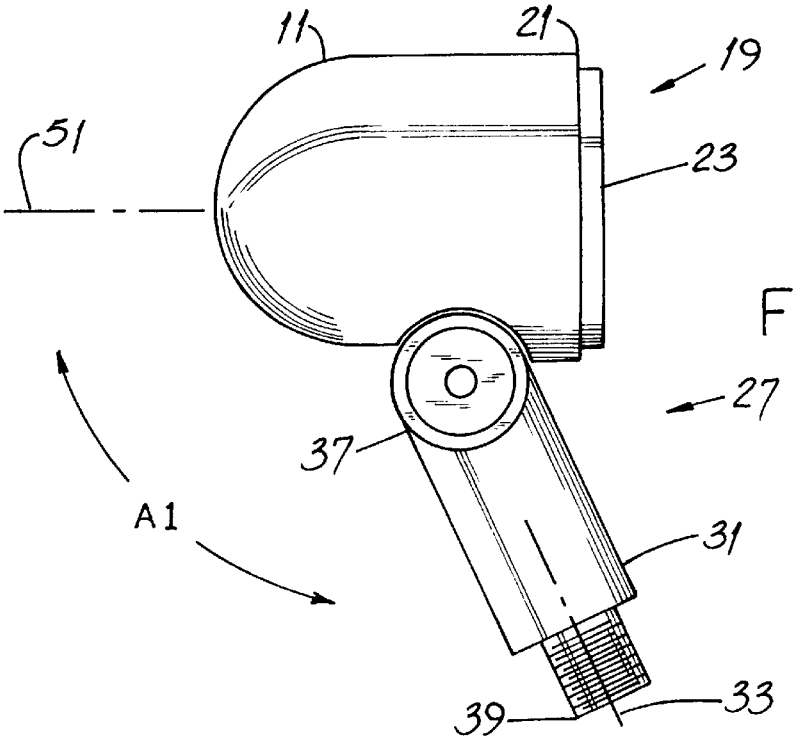
FIG. 6 is a side elevation view generally like that of FIG. 2 but with the strut pivoted to its forwardmost position.

Referring to FIGS. 1, 3, 4 and 5, the housing forward opening 19 is symmetrical about the housing long axis 51. An elongate recess 61 is formed along that part of the housing body 13 to which the mounting boss 29 and pivot member 41 are attached and when the strut 31 is folded against the housing 11 as shown in FIGS. 3, 4 and 5, the strut 31 is received in the recess 61. And when the strut 31 is so positioned, the strut axis 33 is substantially parallel to the housing long axis 51.

Figure 8:
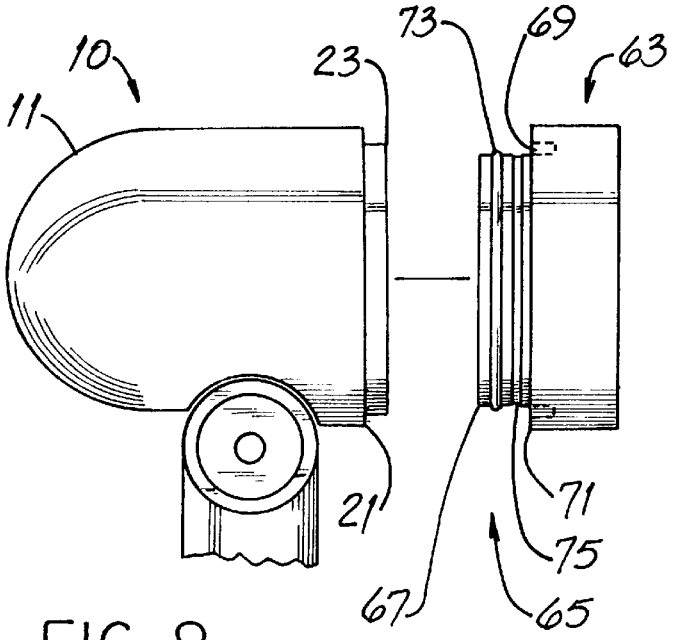
FIG. 8 is an exploded view of a first embodiment of the floodlight configured to receive an exemplary MR 16 lamp. Parts are broken away and surfaces of parts are shown in dashed outline.

FIG. 8 shows the directional floodlight 10 configured for use with an MR 16 low voltage lamp. In addition to the main housing 11, the floodlight of FIG. 8 also includes a lens housing 63 having an attachment portion 65 embodied as a rearwardly-extending, double-groove flange 67 sized to fit within the lip 23 with sliding clearance. An annular channel 69 circumscribes the flange 67 and receives the lip 23 in overlapping, slightly-telescoped relationship when the lens housing 63 is mounted to the main housing 11. The channel 69 and lip 23 are sized so that when the lens housing 63 is fully seated, the shoulder 71 of the lens housing 63 is substantially against the rim 21 of the main housing 11. An O-ring 73 is fitted in the rearmost groove and a set screw (not shown) extends from the main housing 11 into the groove 75 to secure the lens housing 63 to the main housing 11.

Referring now to FIGS. 5, 9, 10, 11 and 12, the next part of the specification describes several different center housings 77*a*, 77*b*, 77*c*, each having a rearwardly-extending attachment portion 79*a*, 79*b*, 79*c*, respectively, and a forwardly-extending ring terminus 81*a*, 81*b*, 81*c*, respectively. Most preferably, the attachment portion 79 of each of the center housings 77 has a single-groove flange 83 with an O-ring 73 in a groove around such flange 83. An annular mount ring 85 is between the portion 79 and the terminus 81 and has a pair of screw holes 87 through it. Screws extend through the holes 87 and thread to correspondingly-positioned holes 25 in the main housing 11.

Most preferably, the flange 83 and surrounding annular channel 89 of each center housing 77 are configured to be substantially identical to the flange 67 and channel 69 of the above-described lens housing 63. In that way, the lens housing 63 for the MR 16 floodlight and the center housings 77*a*, 77*b*, 77*c* all fit a common main housing 11.

The center housings 77 include first and second center housings 77*a*, 77*b*, respectively, either of which can be mounted to the main housing 11. Each of the center housings 77*a*, 77*b* includes an attachment portion 79*a*, 79*b* like the portion 65 of the lens housing 63 described above.

A lamp-protecting portion 91 resembles a truncated cone 93 and extends from the attachment portion 79*a* or 79*b*. Each of the lamp-protecting portions 91 has a maximum diameter DI1, DI2, respectively, and the diameter DI1 of the lamp-protecting portion 91 of the first center housing 77*a* is less than the diameter DI2 of the lamp-protecting portion 91 of the second center housing 77*b*. So configured, the floodlight 10 can be fitted with the first center housing 77*a* to receive, for example, a PAR 20 lamp or be fitted with the second center housing 77*b* to receive a larger lamp, e.g., a PAR 30 lamp.

The first and second center housings 77*a*, 77*b* also have a first ring terminus 81*a* and a second ring terminus 81*b*, respectively. Each ring terminus 81*a*, 81*b* includes a forwardly-extending double-grooved flange 95*a*, 95*b*, respectively, sized to fit within the lip 97*a*, 97*b* of the related lens housing 99*a* or 99*b* with sliding clearance. A second annular channel 101 circumscribes the flange 95*a* or 95*b* and receives the lip 97*a*, 97*b* in overlapping, slightly-telescoped relationship when a lens housing 99*a* or 99*b* is urged onto its respective center housing 77*a* or 77*b*. The channel 101 and lip 97*a*, 97*b* are sized so that when the lens housing 99*a*, 99*b* is fully seated, the shoulder 71 of the lens housing 99*a*, 99*b* is substantially against the rim 21 of the center housing 77*a*, 77*b*. A sealing O-ring 103 is fitted in a groove and a set screw (not shown) extends from the lens housing 99*a*, 99*b* into the groove 105.

Figure 11:
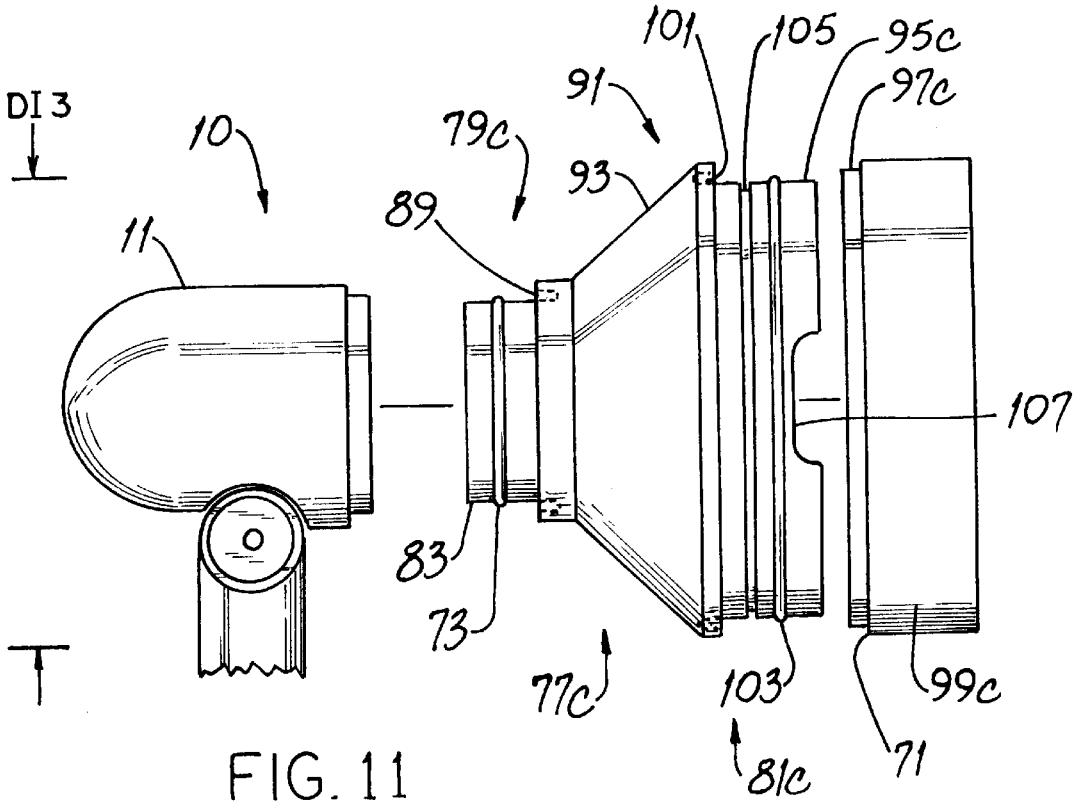
FIG. 11 is an exploded view of a fourth embodiment of the floodlight configured to receive an exemplary PAR 38 lamp. Parts are broken away and surfaces of parts are shown in dashed outline.

Referring particularly to FIGS. 11, the floodlight 10 may use a third center housing 77*c* to receive a still-larger lamp such as a PAR 38 lamp. The third center housing 77*c* has an attachment portion 79*c* configured to be substantially identical to the attachment portions 79*a*, 79*b* of the first and second housings 77*a*, 77*b*. Such third center housing 77*c* also has a ring terminus 81*c* with forwardly-extending flange 95*c*, both shaped and grooved like ring terminii 81*a*, 81*b* and flanges 95*a*, 95*b* of the first and second housings 77*a*, 77*b* but sized larger than such terminii 81*a*, 81*b* and flanges 95*a*, 95*b*. That is, the ring terminus 81*c* has a forward channel 101, an O-ring 103 and a groove 105 for the purposes described above.

The diameter DI1 of the lamp-protecting portion 91 of the second center housing 77*b* is less than the diameter DI3 of the lamp-protecting portion 91 of the third center housing 77*c*. And the diameter and configuration of the third lens housing 99*c* are selected so that such housing 99*c* fits to the ring terminus 81*c*. The third lens housing 99*c* also has a shoulder 71 and a lip 97*c*, the latter fitting into the channel 101.

The floodlight 10 also has a worthwhile convenience feature. Each forward flange 95*a*, 95*b*, 95*c* includes a pair of diametrically-opposed notches 107. Such notches 107 help grasp the rim of a lamp "nested" well into a center housing 77*a*, 77*b*, 77*c* and facilitate easy lamp installation or removal.

The aforedescribed configurations of the main housing 11, center housings 77 and lens housings 99 are particularly effective in preventing rain water from entering a floodlight 10. Considering FIG. 9 for example, if the floodlight 10 is pointed downwardly, rain water flowing downwardly along the surface 109 or the surface 111 may run into the channel 89 or to the shoulder 71. But such water is prevented by gravity from running upwardly along the flanges 83 or 95*a* and into the housing 11. And the O-rings 73, 103 also exclude water.

Figure 9:
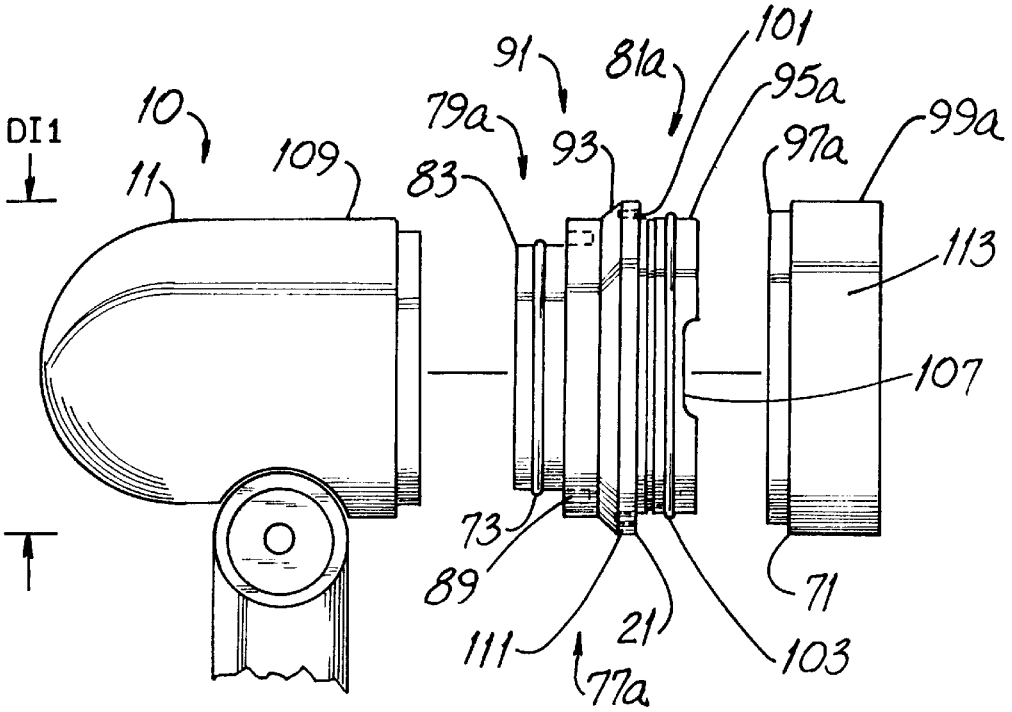
FIG. 9 is an exploded view of a second embodiment of the floodlight configured to receive an exemplary PAR 20 lamp. Parts are broken away and surfaces of parts are shown in dashed outline.

Similarly, if the floodlight 10 of FIG. 9 is pointed upwardly, rain water flowing downwardly along the surface 111 or the surface 113 is prevented by gravity and by the O-rings 73, 103 from running upwardly and into the housing 11.

And the new floodlight 10 is not limited to use with low voltage or PAR lamps. Referring to FIGS. 1, 2, 5 and 13, in another embodiment, the main housing 11 includes a socket 115 configured for receiving a high intensity discharge (HID) lamp. The floodlight 10 further includes an elongate compartment 117 to receive a ballast attached to the lamp when the floodlight 10 is installed ready for operation. The compartment 117 includes a mounting box 119 and a cover 121 mounted thereon and having the distal end 35 of the strut 31 affixed to it.

Considered another way, the foregoing involves a group of floodlight components comprising a main housing 11 and the first and second center housings 77*a*, 77*b* all configured as described and shown. The components group also includes first and second lens housings 99*a*, 99*b* sized to be received on the first and second ring terminus 81*a*, 81*b*, respectively. As described above, the first and second attachment portions 79*a*, 79*b* are sized and configured to be interchangeably received at the forward opening 19.

A more specific group of floodlight components includes a third center housing 99*c* having a third attachment portion 79*c* and a third ring terminus 81*c*. Like the first and second attachment portions 79*a*, 79*b* of the first and second center housings 77*a*, 77*b*, respectively, the third attachment portion 79*c* is sized and configured to be received at the forward opening 19.

Figure 10:
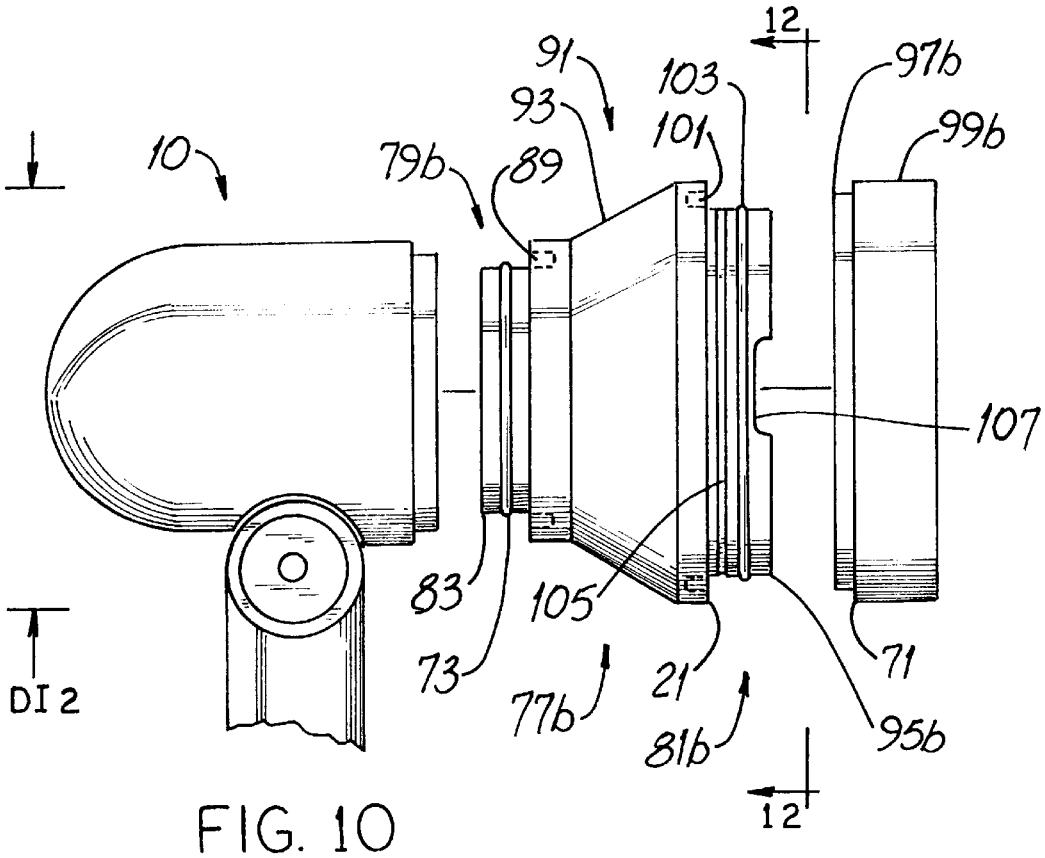
FIG. 10 is an exploded view of a third embodiment of the floodlight configured to receive an exemplary PAR 30 lamp. Parts are broken away and surfaces of parts are shown in dashed outline.
Figure 13:
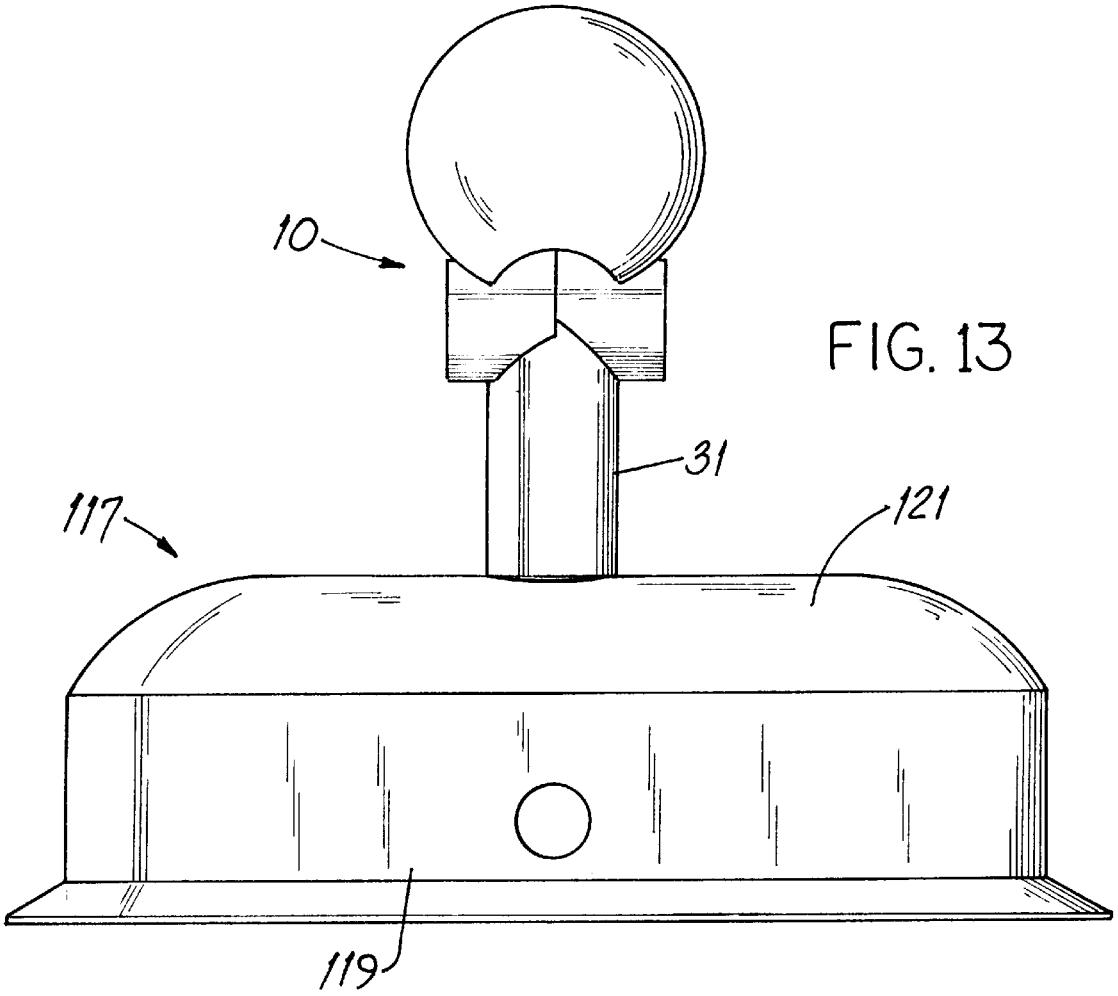
FIG. 13 is an elevation view of the housing of FIG. 1 mounted to a compartment for receiving the ballast of an HID lamp.
Figure 7:
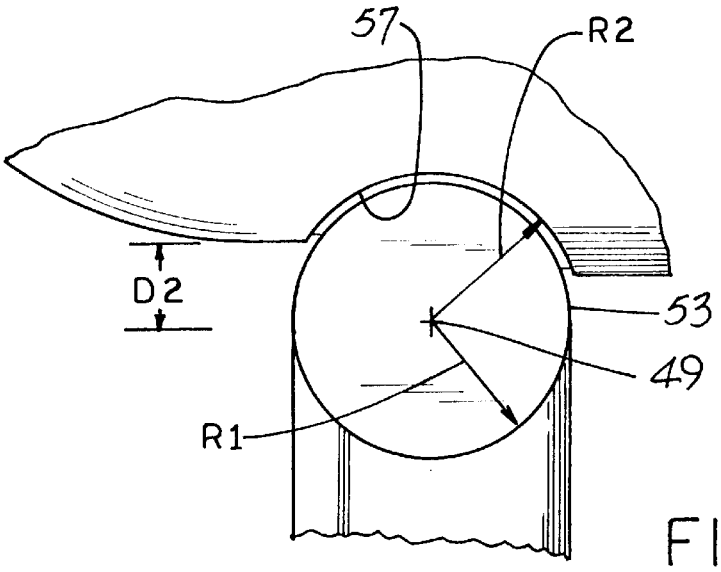
FIG. 7 is an enlarged elevation view of portions of the housing of FIG. 2. Parts are broken away and surfaces of certain parts are omitted for clarity.
Figure 14:
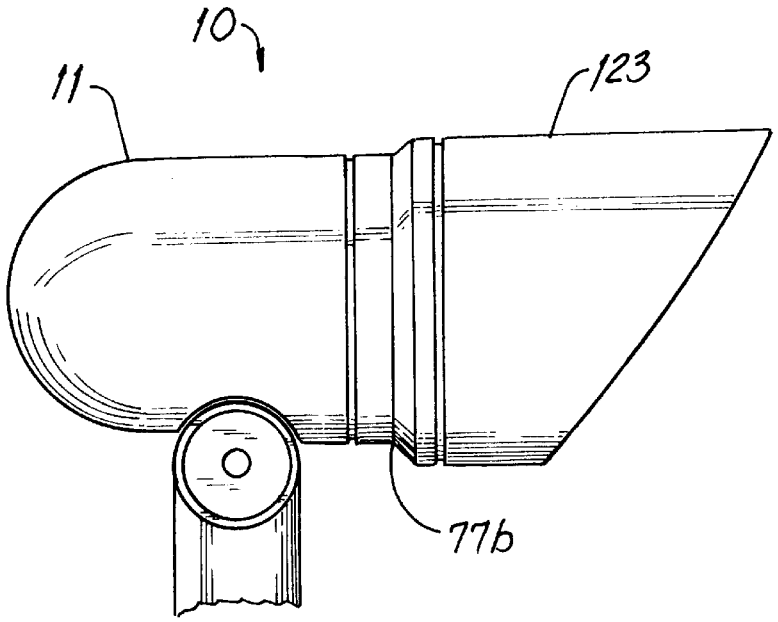
FIG. 14 is a side elevation view of a variation of the embodiment of FIG. 9 fitted with a shroud in place of the lens housing. Parts are broken away.

Referring also to FIG. 14, a still-more-specific group of components includes at least a first hood-like shroud 123 for further glare prevention and to provide greater "directionality." While FIG. 14 shows the floodlight 10 of FIG. 9 fitted with the shroud 123 rather than the lens housing 99*a*, the floodlights 10 of FIGS. 8, 10 and 11 may be fitted with a shroud 123 like that shown in FIG. 14. (It is, no doubt, understood that the shroud 123 preferably includes a shoulder 71 and lip 97 configured appropriately in view of the particular center housing 77 to which the shroud 123 is fitted.)

While the principles of the invention have been shown and described in connection with a few preferred embodiments, it is to be understood clearly that such embodiments are by way of example and are not limiting.

What is claimed:

1. In a floodlight having a housing extending along a housing axis and a housing support coupled to the housing, the improvement wherein:

the support includes a strut having a distal end and a pivot member at a proximal end;

the pivot member is mounted for movement about a pivot axis and has a boundary spaced from the pivot axis by a first dimension, the pivot member being pivotably secured to the housing at an intermediate position along the length of the housing; and the housing includes housing surface portions proximate the pivot axis on each side of the pivot member and each spaced from the pivot axis in a direction perpendicular to the housing axis by a second dimension less than the first dimension.

2. The floodlight of claim 1 wherein:

the boundary is a convex surface and has a radius of curvature equal to the first dimension; and the housing includes a concave pivot surface having a radius of curvature greater than the second dimension.

3. The floodlight of claim 2 wherein the concave pivot surface has a radius of curvature greater than the first dimension.

4. The floodlight of claim 1 wherein:

the housing includes a long axis and a recess along the housing; and when the strut is folded against the housing, the strut is in the recess.

5. The floodlight of claim 4 wherein:

the housing includes a forward opening symmetrical about the long axis; and when the strut is folded against the housing, the strut axis is substantially parallel to the long axis.

6. The floodlight of claim 5 wherein:

the housing includes a substantially cylindrical mounting boss affixed thereto; and the pivot member is substantially cylindrical and coextensive with the mounting boss.

7. The floodlight of claim 1 wherein:

the housing has a body, a rear body terminus and a forward body opening and is substantially symmetrical about a plane coincident with the rear body terminus and the forward opening;

the body has a mounting boss affixed thereto and having a face substantially coincident with the plane; and the pivot member has a face substantially coincident with the plane.

8. The floodlight of claim 1 wherein:

the housing is a main housing having a forward opening and the floodlight further includes alternate first and second center housings;

and wherein each of the center housings includes:

an attachment portion sized to be received by the forward opening with slight clearance; and a lamp-protecting portion extending from the attachment portion;

and wherein:

each of the lamp-protecting portions has a diameter; and the diameter of the lamp-protecting portion of the first center housing is less than the diameter of the lamp-protecting portion of the second center housing.

9. The floodlight of claim 8 wherein the main housing includes a socket for receiving a high intensity discharge lamp and the floodlight further includes:

an elongate compartment containing a ballast attached to the lamp.

10. The floodlight of claim 9 wherein the compartment includes:

a mounting box; and a cover mounted on the box and having the distal end of the strut affixed thereto.

11. Adaptable floodlight apparatus comprising:

a main housing having a forward opening;

a plurality of center housings each having an attachment portion and a ring terminus at its opposite ends, the attachment portions being similarly sized for interchangeable attachment to the forward opening of the main housing and the ring terminuses being sized differently from one another; and a plurality of lens housings sized differently from one another, each of the lens housings sized to be received on one of the ring terminuses, whereby the floodlight is capable of accommodating lamps of differing sizes.

12. The apparatus of claim 11 further including a shroud sized to be received on one of the ring terminuses.

13. The apparatus of claim 11 further including a lens housing sized to be received at the forward opening of the main housing.

14. The apparatus of claim 11 wherein:

the main housing extends along a main housing axis and a housing support is coupled to the main housing;

the support includes a strut having a distal end and a pivot member at a proximal end;

the pivot member is mounted for movement about a pivot axis and has a boundary spaced from the pivot axis by a first dimension, the pivot member being pivotably secured to the main housing at an intermediate position along the length of the main housing; and the main housing includes housing surface portions proximate the pivot axis on each side of the pivot member and each spaced from the pivot axis in a direction perpendicular to the main housing axis by a second dimension less than the first dimension.

15. The apparatus of claim 14 wherein:

the boundary is a convex surface and has a radius of curvature equal to the first dimension; and the housing includes a concave pivot surface having a radius of curvature greater than the second dimension.

16. The apparatus of claim 15 wherein the concave pivot surface has a radius of curvature greater than the first dimension.

17. The apparatus of claim 14 wherein:

the housing includes a long axis and a recess along the housing; and when the strut is folded against the housing, the strut is in the recess.

18. The apparatus of claim 17 wherein:

the housing includes a forward opening symmetrical about the long axis; and when the strut is folded against the housing, the strut axis is substantially parallel to the long axis.

19. The apparatus of claim 18 wherein:

the housing includes a substantially cylindrical mounting boss affixed thereto; and the pivot member is substantially cylindrical and coextensive with the mounting boss.

20. The apparatus of claim 14 wherein:

the housing has a body, a rear body terminus and a forward body opening and is substantially symmetrical about a plane coincident with the rear body terminus and the forward opening;

the body has a mounting boss affixed thereto and having a face substantially coincident with the plane; and the pivot member has a face substantially coincident with the plane.

21. The apparatus of claim 14 wherein:

the housing is a main housing having a forward opening and the floodlight further includes alternate first and second center housings;

and wherein each of the center housings includes;

an attachment portion sized to be received by the forward opening with slight clearance; and a lamp-protecting portion extending from the attachment portion;

and wherein:

each of the lamp-protecting portions has a diameter; and the diameter of the lamp-protecting portion of the first center housing is less than the diameter of the lamp-protecting portion of the second center housing.

22. The apparatus of claim 21 wherein the main housing includes a socket for receiving a high intensity discharge lamp and the floodlight further includes:

an elongate compartment containing a ballast attached to the lamp.

23. The apparatus of claim 22 wherein the compartment includes:

a mounting box, and a cover mounted on the box and having the distal end of the strut affixed thereto.

* * * * *